US009228422B2

(12) United States Patent
Watson et al.

(10) Patent No.: US 9,228,422 B2
(45) Date of Patent: Jan. 5, 2016

(54) LIMITED DEPTH ABRASIVE JET CUTTER

(71) Applicant: Thru Tubing Solutions, Inc., Oklahoma City, OK (US)

(72) Inventors: Brock W. Watson, Oklahoma City, OK (US); Roger L. Schultz, Ninnekah, OK (US)

(73) Assignee: Thru Tubing Solutions, Inc., Oklahoma City, OK (US)

( * ) Notice: Subject to any disclaimer, the term of this patent is extended or adjusted under 35 U.S.C. 154(b) by 312 days.

(21) Appl. No.: 13/749,434

(22) Filed: Jan. 24, 2013

(65) Prior Publication Data

US 2013/0192830 A1 Aug. 1, 2013

Related U.S. Application Data

(60) Provisional application No. 61/592,312, filed on Jan. 30, 2012.

(51) Int. Cl.
*E21B 43/114* (2006.01)
*E21B 29/00* (2006.01)

(52) U.S. Cl.
CPC ..... *E21B 43/114* (2013.01); *E21B 29/002* (2013.01)

(58) Field of Classification Search
CPC ..... E21B 29/00; E21B 43/114
USPC ..... 166/298, 55.8
See application file for complete search history.

(56) References Cited

U.S. PATENT DOCUMENTS

| | | | |
|---|---|---|---|
| 1,279,333 | A | 9/1918 | Green |
| 2,312,018 | A | 2/1943 | Beckman |
| 2,828,107 | A | 3/1958 | Bobo |
| 3,066,735 | A | 12/1962 | Zingg |
| 3,116,800 | A | 1/1964 | Kammerer |
| 3,145,776 | A | 8/1964 | Pittman |
| 3,795,282 | A | 3/1974 | Oliver |
| 4,050,529 | A | 9/1977 | Tagirov et al. |
| 4,499,951 | A | 2/1985 | Vann |
| 4,518,041 | A | 5/1985 | Zublin |

(Continued)

FOREIGN PATENT DOCUMENTS

| | | | |
|---|---|---|---|
| EP | 0452126 | A2 | 10/1991 |
| SU | 709803 | A1 | 1/1980 |

(Continued)

OTHER PUBLICATIONS

Written Opinion and International Search Report mailed Mar. 11, 2014, in International Appl. No. PCT/US2013/023084, corresponding to the instant application.

*Primary Examiner* — Brad Harcourt
(74) *Attorney, Agent, or Firm* — Mary M. Lee

(57) ABSTRACT

Tools and methods for abrasively cutting downhole pipes and casing. The tools and methods are ideally suited for situations where the pipe to be cut or perforated is positioned partly or wholly inside another pipe and damage to the outer pipe must be avoided. The jet nozzles are positioned at a non-normal angle to the target surface to reduce the jets' effective cutting distance. While pumping the abrasive fluid, the jets are supported at a selected radial distance from the target surface so that within a predetermined operating time the jets will cut or perforate the inner pipe but leave the outer pipe substantially intact. The tool may be rotated with a motor to perform cutoff operations or held in a fixed position for perforating.

34 Claims, 7 Drawing Sheets

(56) References Cited

U.S. PATENT DOCUMENTS

| | | | |
|---|---|---|---|
| 4,638,873 | A | 1/1987 | Welborn |
| 4,815,540 | A | 3/1989 | Wallbillich, III |
| 4,967,841 | A | 11/1990 | Murray |
| 5,318,123 | A | 6/1994 | Venditto et al. |
| 5,381,631 | A | 1/1995 | Raghavan et al. |
| 5,499,678 | A | 3/1996 | Surjaatmadja et al. |
| 5,499,687 | A | 3/1996 | Lee |
| 5,533,571 | A | 7/1996 | Surjaatmadja et al. |
| 5,564,500 | A | 10/1996 | Rogers et al. |
| 6,085,843 | A | 7/2000 | Edwards et al. |
| 6,189,618 | B1 | 2/2001 | Beeman et al. |
| 6,199,566 | B1 | 3/2001 | Gazewood |
| 6,378,612 | B1 | 4/2002 | Churchill |
| 6,439,866 | B1 | 8/2002 | Farkas et al. |
| 6,491,098 | B1 | 12/2002 | Dallas |
| 6,520,255 | B2 | 2/2003 | Tolman et al. |
| 6,564,868 | B1 | 5/2003 | Ferguson et al. |
| 6,732,793 | B1 | 5/2004 | Lee |
| 7,195,067 | B2 | 3/2007 | Manke et al. |
| 7,357,182 | B2 | 4/2008 | Hunt et al. |
| 7,617,871 | B2 | 11/2009 | Surjaatmadja et al. |
| 7,673,673 | B2 | 3/2010 | Surjaatmadja et al. |
| 7,841,396 | B2 | 11/2010 | Surjaatmadja |
| 7,963,331 | B2 | 6/2011 | Surjaatmadja et al. |
| 7,963,332 | B2 | 6/2011 | Dotson et al. |
| 8,066,059 | B2 | 11/2011 | Ferguson et al. |
| 8,132,625 | B2 | 3/2012 | Anderson |
| 8,210,250 | B2 | 7/2012 | Ferguson et al. |
| 8,230,912 | B1 | 7/2012 | Connell |
| 8,240,373 | B1 | 8/2012 | Britton et al. |
| 8,365,818 | B2 | 2/2013 | Schultz et al. |
| 8,381,817 | B2 | 2/2013 | Schultz et al. |
| 8,403,049 | B2 | 3/2013 | Ferguson et al. |
| 8,424,605 | B1 | 4/2013 | Schultz et al. |
| 8,439,117 | B2 | 5/2013 | Schultz et al. |
| 8,448,700 | B2 | 5/2013 | Connell et al. |
| 8,453,745 | B2 | 6/2013 | Schultz et al. |
| 2002/0092650 | A1 | 7/2002 | Tolman et al. |
| 2004/0089450 | A1 | 5/2004 | Slade et al. |
| 2005/0263284 | A1 | 12/2005 | Justus |
| 2006/0027368 | A1 | 2/2006 | Manke et al. |
| 2006/0201675 | A1 | 9/2006 | Ferguson et al. |
| 2006/0243455 | A1 | 11/2006 | Telfer et al. |
| 2006/0278393 | A1 | 12/2006 | Hunt et al. |
| 2007/0181313 | A1 | 8/2007 | Churchill |
| 2008/0135248 | A1 | 6/2008 | Talley et al. |
| 2008/0223587 | A1 | 9/2008 | Cherewyk |
| 2008/0271892 | A1 | 11/2008 | Lynde et al. |
| 2008/0283299 | A1 | 11/2008 | Surjaatmadja |
| 2009/0032255 | A1 | 2/2009 | Surjaatmadja et al. |
| 2009/0308588 | A1 | 12/2009 | Howell et al. |
| 2010/0044041 | A1 | 2/2010 | Smith |
| 2010/0170675 | A1* | 7/2010 | Daigle et al. ..... 166/298 |
| 2010/0212903 | A1 | 8/2010 | Dotson et al. |
| 2010/0276204 | A1 | 11/2010 | Connell et al. |
| 2011/0114316 | A2 | 5/2011 | Ferguson et al. |
| 2011/0146989 | A1 | 6/2011 | Dotson |
| 2011/0259602 | A1 | 10/2011 | Britton |
| 2011/0315403 | A1 | 12/2011 | Nard et al. |
| 2012/0024519 | A1 | 2/2012 | Ferguson et al. |
| 2012/0024538 | A1 | 2/2012 | Britton |
| 2012/0031615 | A1 | 2/2012 | Connell et al. |
| 2012/0118557 | A1 | 5/2012 | Ferguson et al. |
| 2012/0152550 | A1 | 6/2012 | East, Jr. |
| 2012/0167994 | A1 | 7/2012 | Schultz et al. |
| 2012/0227970 | A1 | 9/2012 | Schultz et al. |
| 2012/0291539 | A1 | 11/2012 | Schultz |
| 2012/0292015 | A1 | 11/2012 | Schultz |
| 2012/0292016 | A1 | 11/2012 | Schultz |
| 2012/0292017 | A1 | 11/2012 | Schultz |
| 2012/0292018 | A1 | 11/2012 | Schultz |
| 2012/0292019 | A1 | 11/2012 | Schultz |
| 2012/0292020 | A1 | 11/2012 | Schultz |
| 2012/0292033 | A1 | 11/2012 | Schultz |
| 2012/0292113 | A1 | 11/2012 | Schultz |
| 2012/0292116 | A1 | 11/2012 | Schultz |
| 2013/0000909 | A1 | 1/2013 | Schultz et al. |

FOREIGN PATENT DOCUMENTS

| | | | |
|---|---|---|---|
| SU | 1132001 | A1 | 12/1984 |
| WO | 2011136830 | A1 | 3/2011 |
| WO | WO2011136830 | A1 | 11/2011 |
| WO | 2012018700 | A2 | 2/2012 |
| WO | WO2012018700 | A2 | 2/2012 |
| WO | 2012082514 | A2 | 6/2012 |
| WO | WO2012082514 | A2 | 6/2012 |
| WO | 2012122141 | A1 | 9/2012 |
| WO | WO2012122141 | A1 | 9/2012 |
| WO | 2012158575 | A2 | 11/2012 |
| WO | WO2012158575 | A2 | 11/2012 |

* cited by examiner

LIMITED DEPTH ABRASIVE JET CUTTER

CROSS-REFERENCE TO RELATED APPLICATIONS

This application claims the benefit of U.S. Provisional Application No. 61/592,312 entitled "Limited Depth Abrasive Jet Cutter," filed Jan. 30, 2012, the contents of which are incorporated herein by reference.

FIELD OF THE INVENTION

The present invention generally relates to downhole tools and more particularly to tools for abrasively perforating and cutting pipe in oil and gas wells.

BRIEF DESCRIPTION OF THE DRAWINGS

The accompanying drawings, which are incorporated into and form a part of the specification, illustrate one or more embodiments of the present invention and, together with this description, serve to explain the principles of the invention. The drawings merely illustrates one or more preferred embodiments of the invention and are not to be construed as limiting the scope of the invention.

DETAILED DESCRIPTION OF THE PREFERRED EMBODIMENT(S)

Abrasive jet cutters are commonly used in the oilfield to cut tubing and perforate casing. Abrasive jet cutting of pipe is carried out by pumping a stream of abrasive fluid through an orifice or jet nozzle that is near to and oriented normal to the ID (internal diameter) of the pipe being cut. The abrasive fluid typically comprises a mixture of sand and water so that a high pressure jet will rapidly erode the target surface until it is perforated.

Figure 1:
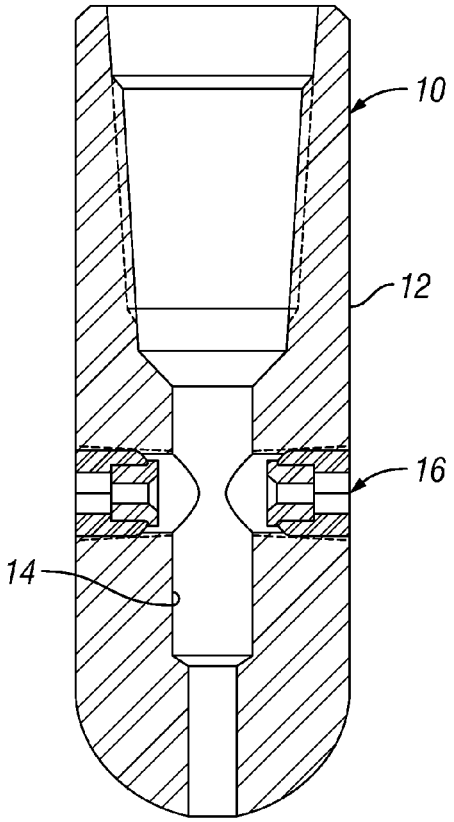
FIG. 1 (Prior Art)
FIG. 1 is a longitudinal section view through a conventional abrasive jet cutting tool commonly used to cut tubing.

A conventional abrasive jet cutting tool is shown FIG. 1 and designated generally by the reference number 10. The tool comprises a tubular housing 12 with a central flow channel 14. At least one and usually several jet nozzles 16 are supported in the sidewall of the housing. In a cutting or "cutoff" operation, a motor (not shown) is used to spin the jet cutter 10 in a circle so that the fluid jets from the nozzles 16 will cut the full perimeter of the pipe (not shown).

Figure 2:
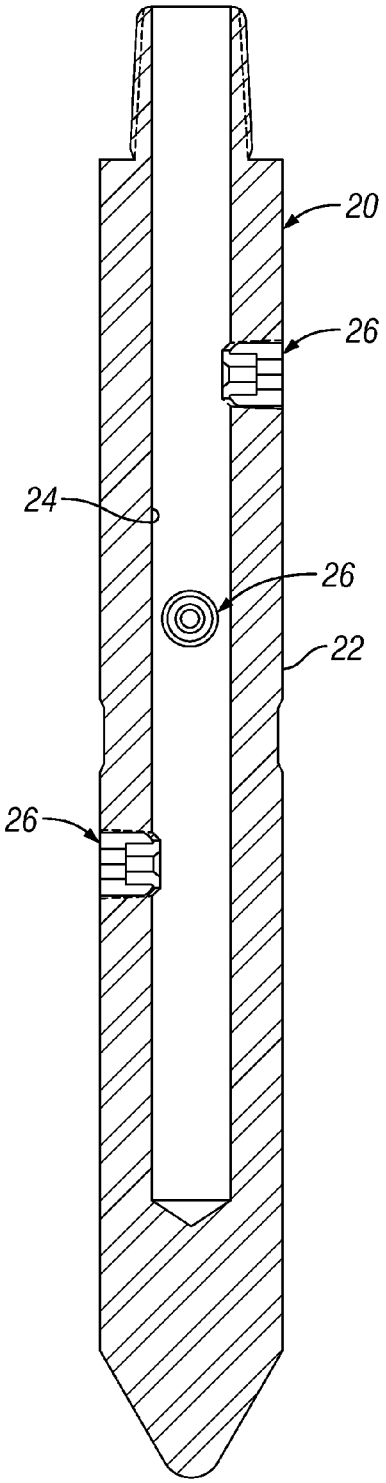
FIG. 2 (Prior Art)
FIG. 2 is a longitudinal sectional view through a conventional abrasive jet cutting tool commonly used to perforate casing.

A conventional abrasive perforator tool is shown in FIG. 2 and designated by the reference number 20. The tool 20 comprises a tubular housing 22 with a central flow channel 24. At least one and preferably several jet nozzles 26 are supported in the sidewall of the housing 22. In most of these perforators, there are multiple rows of nozzles. In a perforating operation, the tool 20 is held in a stationary position while the abrasive fluid is pumped through the nozzles 26 until the casing is perforated.

The usual reason for cutting oilfield tubing is to release the upper end of the tube from the lower end because the lower end is either accidentally stuck in the well bore or has been intentionally cemented in place. In either case, the pipe must be completely severed in order to recover the upper end and remove it from the well to allow other downhole operations to proceed.

Perforation is most often done to well casing to allow fluid communication between the ID and OD (outer diameter) of the casing in the area of the production zone. These perforations allow fracturing fluids to access to the production zone. Additionally, after fracturing is completed, the perforations allow production fluids to enter the casing ID and be carried to the surface. Another reason for perforating is to provide ports in the casing to allow cement to be pumped through from the inside. This usually is done on a cement squeeze job.

In some instances, one pipe or casing may be positioned partly or wholly inside a larger casing. In these situations, it is not uncommon for conventional abrasive cutters and perforators to pierce too deeply and cause unwanted perforation or cutting of the outer pipe or casing. This is a common problem, for example, when cutting to remove a stuck pipe and also when perforating to squeeze cement.

The present invention provides an abrasive jet cutting tool that has a limited cutting depth. This tool is ideal for perforating or cutting off tubing inside a larger pipe or casing where damage to the outer pipe must be minimized. The inventive tool also reduces the rate of penetration after a certain depth of cut has been achieved. That is, at a certain point, the jet of fluid degrades enough that its ability to cut or damage the second pipe is negligible. By placing the nozzle at a non-normal angle, that point of degradation is closer to the inner pipe and thus can be angled so that the point of degradation is inside the range of the outer pipe.

In accordance with the present invention, an abrasive jet cutter is provided in which the jet nozzle or orifice is positioned at an angle to the pipe, or target surface, being cut. Because the jetted fluid is directed at an angle to the target pipe wall, the effective cutting distance of the fluid jet is reduced. The jet angle is such that it will allow reasonable cutting speed on the inside pipe but will eliminate or greatly reduce the cutting speed on the outer casing. Additionally, during the jetting operation, the tool is supported in the pipe to be cut or perforated so that the nozzles are a predetermined radial distance from the target surface.

This proper positioning of the nozzles combined with the selected jetting angle provides effective cutting or perforating of the inner pipe within a reasonable time and yet prevents or delays erosive action on the outer pipe unless the jetting operation is continued for a prolonged period of time. Therefore, by limiting the duration of the jetting operation, the inner pipe can be cutoff or perforated successfully while avoiding damage to the outer pipe or casing.

As mentioned above, in the case of cutoff operations, it is usually desirable to rotate or spin the tool with a motor. In accordance with the present invention, the outer diameter of the tool is selected according to the inner diameter of the pipe to be cut. This will ensure that the nozzle-to-surface distance is within the range necessary to affect the inner pipe without affecting the outer pipe.

In the case of perforating operations, rotation of the tool typically is unnecessary. A simple positioning mechanism, such as a locating arm, may be included in the tool to displace the tool radially toward the target surface while the jetting operation is performed. With such a positioning device, there is no need for the tool to be specifically sized for single pipe ID. Rather, one size tool can accommodate pipes with a range of ID's.

Figure 3:
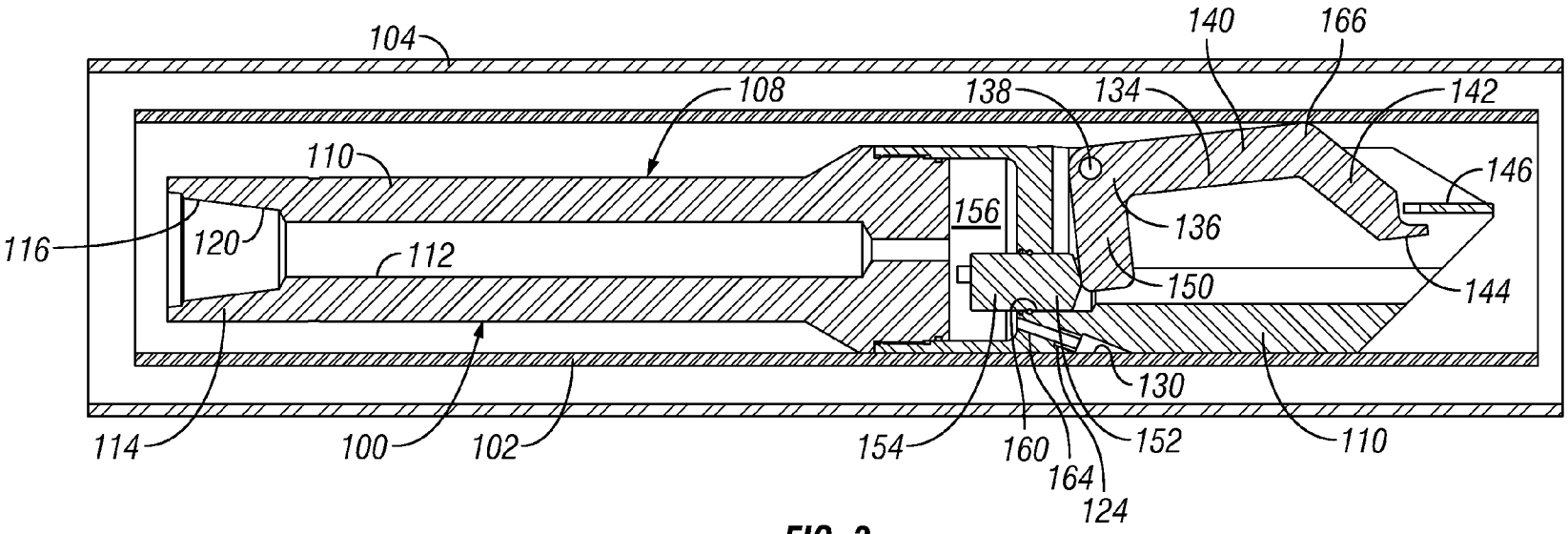
FIG. 3 is longitudinal section view through a jet cutting tool constructed in accordance with a first embodiment of the present invention. The tool is shown in a jetting position inside a pipe inside a casing.
Figure 4:
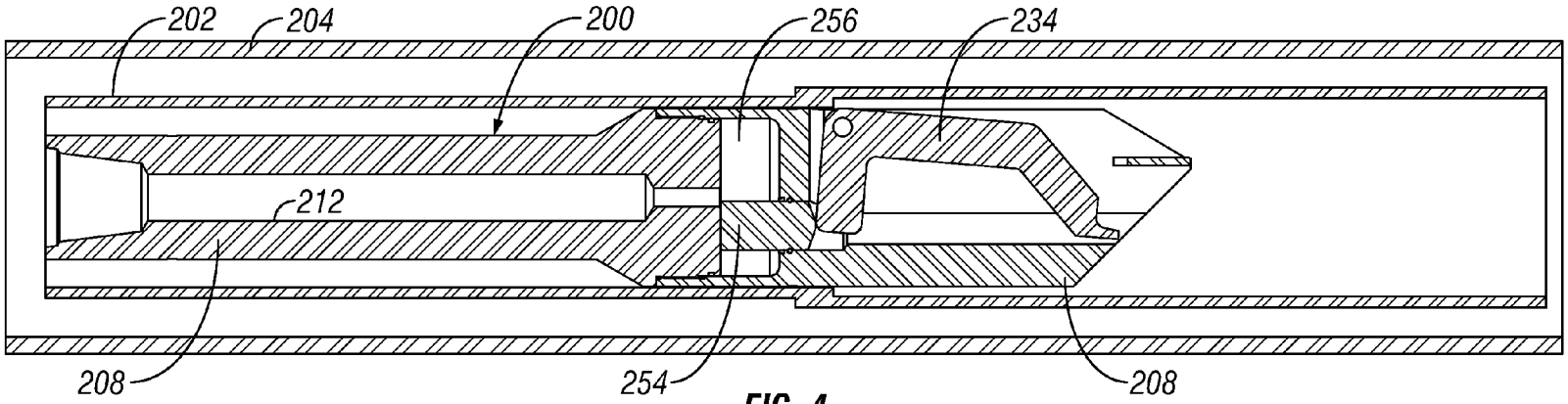
FIG. 4 is a longitudinal sectional view through a jet cutting tool constructed in accordance with a second embodiment of the present invention. The tool is shown in a running position inside a pipe inside a casing.
Figure 5:
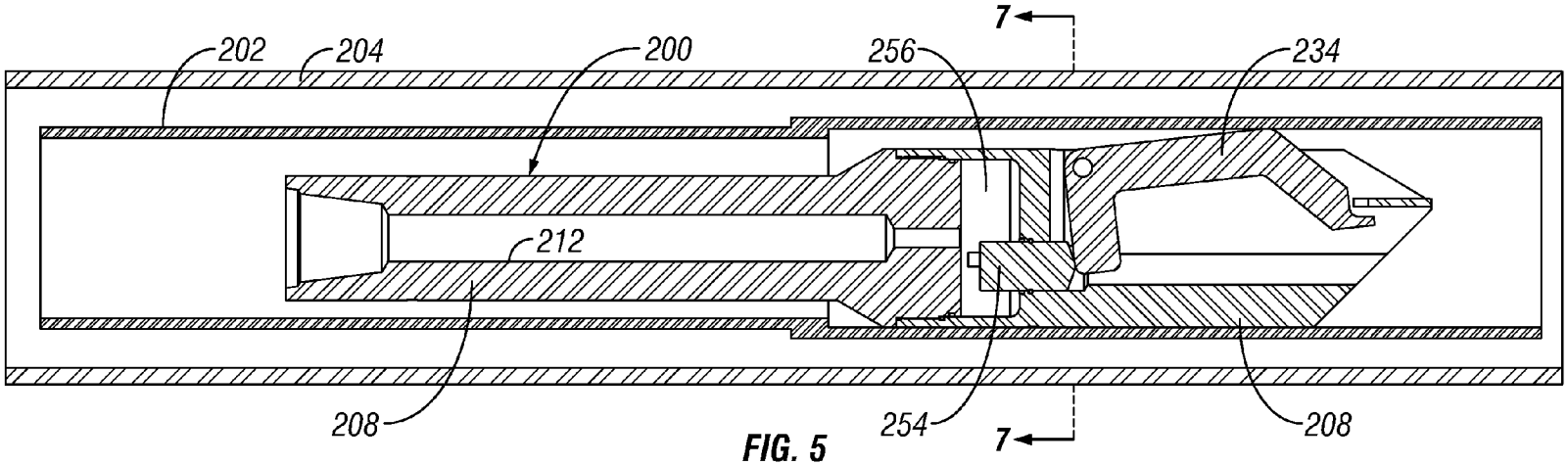
FIG. 5 is a longitudinal sectional view through the jet cutting tool shown in FIG. 4. In this view, the tool is shown in the jetting position.

Turning now to FIG. 3 in particular, there is shown therein an abrasive jet cutter constructed in accordance with a preferred embodiment of the present invention and designated generally by the reference numeral 100. The tool 100 is designed for cutting or perforating a target surface of a pipe. "Pipe" is used generically herein to refer to any tubular member downhole including, for example but without limitation, coiled tubing, drill pipe, and well casing. The tool 100 is particularly designed for perforating or cutting off one pipe that is disposed inside another pipe. By way of example, only the inner pipe 102 may be a section of drill string, and the outer pipe 104 may be the well casing.

The tool 100 comprises a tubular housing 108 having a sidewall 110 that defines a fluid channel 112. The uphole end 114 of the housing 108 has an inlet 116 for the fluid channel 112. The uphole end 114 is connectable to coiled tubing or other drill string, such as by threads 120, and through which abrasive fluid can be pumped. "Drill string" refers generally to the coiled tubing or drill pipe used to deploy the tool.

At least one and in most instances a plurality of jet nozzles 124 are mounted in the sidewall 110 of the housing 108. The nozzles 124 fluidly communicate with the fluid channel 112 and are positioned to direct a fluid jet at a selected angle, referred to herein as the "jetting angle." The selected jetting angle is non-normal to the target surface, which is the inner wall of the inner pipe 102, designated generally at 130 in FIG. 3. That is, the jetting angle is non-perpendicular to the longitudinal axis of the tool 100 and more specifically the longitudinal axis of the inner pipe 102 at the level of the target surface 130. As used herein, "non-normal jetting angle" refers to the angle of incidence of the fluid jet relative to the target surface 130 and excludes an angle that is perpendicular or normal to target surface.

The tool housing 108 is configured to support the jet nozzles 124 at a selected radial distance from the target surface 130 while the abrasive fluid is pumped through the drill string. In the case of a tool for cutoff operations, the housing may be a simple tubular similar to the conventional tool shown in FIG. 1. However, in accordance with the present invention, the outer diameter of the housing and more particularly the outlet of the jet nozzles are selected based on the inner diameter of the inner pipe to achieve the predetermined nozzle-to-target surface distance. Such a tool may be used with a conventional motor to rotate the housing.

In the case of tools for perforating operations, where rotation is unnecessary, the tool may be equipped with a positioning member to shift the housing radially toward the target surface to achieve the selected radial distance from the target surface. The position member is extendable and retractable from the housing. This is the type of tool shown in FIG. 3. In this particular embodiment, the positioning member takes the form of a generally L-shaped arm 134 pivotally mounted at its heel 136 on a pin 138. The distal or downhole end 142 of the arm 134 has a toe 144 that catches on tab 146 in the housing 108; this limits the outward swing of the arm.

The shorter section 150 of the arm 134 engages the distal or downhole end 152 of a cylindrical piston 154. A hydraulic chamber 156 is formed inside the housing 108. The chamber 156 has an inlet fluidly connected to the fluid channel 112 and includes a piston bore 160 for slidably receiving the piston 154 so that upper end of the piston is responsive to pressure changes in the chamber 156. Now it will be apparent that, as the piston 154 moves downwardly in response to increasing hydraulic pressure in the chamber 156, the lower end 152 of the piston pushes down on the free end of the short section 150 of the arm 134, pivoting the longer section 140 out toward the inner pipe wall opposite the target surface 130. Abrasive fluid passes through the hydraulic chamber 156, through a jetting port 164 formed in the housing 208 that directs the fluid through the nozzle 124.

As seen in FIG. 3, the long section 140 of the arm 134 is angled at 166 to ease movement of the tool uphole and downhole in the well. When the hydraulic pressure in the chamber 156 decreases, pressure on the arm 134 as it engages the inner pipe wall will force the arm back into the housing 108.

In the embodiment shown in FIG. 3, the tool 100 has a jet nozzle 124 opposite the positioning arm 134. When the hydraulic pressure increases, extension of the arm 134 pushes the nozzle side of the tool housing 108 towards the target surface 130. The distance of the nozzle outlet can be adjusted by recessing the nozzle. For example, in one preferred embodiment, the nozzle is recessed to achieve a nozzle to outer pipe distance of about 0.450 inch.

The tool 100 is connectable to coiled tubing or other tubular conduit and deployed down the well in a conventional manner until it is positioned at the desired location in the inner pipe 102. Once the tool 100 is positioned, abrasive fluid is pumped through the tool. As the hydraulic pressure rises, the piston 154 moves down pushing the arm 134 out against the inner wall of the pipe 102 and shifting the tool housing 108 over so that the nozzles 124 are adjacent the target surface 130.

Pumping pressure is maintained for a first predetermined interval to ensure satisfactory perforation of the inner pipe 102 without damage to the outer pipe 104. The tool 100 may be repositioned by rotating it or advancing or withdrawing the tool string, or both, while interrupting the flow of fluid to release the arm 134. After the perforating operation is completed, the tool 100 is withdrawn.

Figure 7:
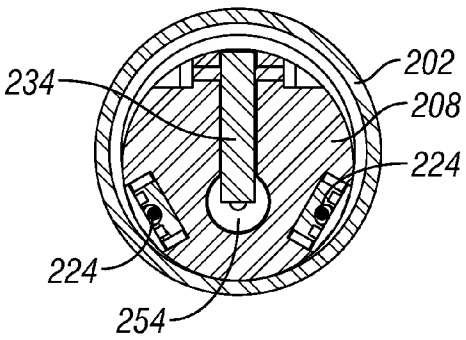
FIG. 7 is a cross-sectional view through the jet cutting tool of FIG. 5 taken along line 7-7 of FIG. 5.
Figure 6:
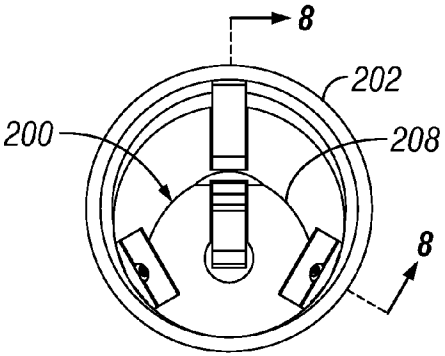
FIG. 6 is an end view of the uphole end of the jet cutting tool of FIG. 5.

Another embodiment of the abrasive cutting tool of the present invention is shown in FIGS. 4-9, to which attention now is directed. This jet cutting tool, designated generally at 200, is also designed for perforator operations and is shown positioned inside an inner pipe 202 which is inside an outer pipe 204. The tool 200 comprises a housing 208 with a fluid channel 212. In this embodiment, only two jet nozzles 224 are provided, as best seen in FIG. 7. These nozzles 224 are mounted opposite the pivotally mounted arm 234, which is actuated by a piston 254 driven by increasing hydraulic pressure in the hydraulic chamber 256.

Figure 8:
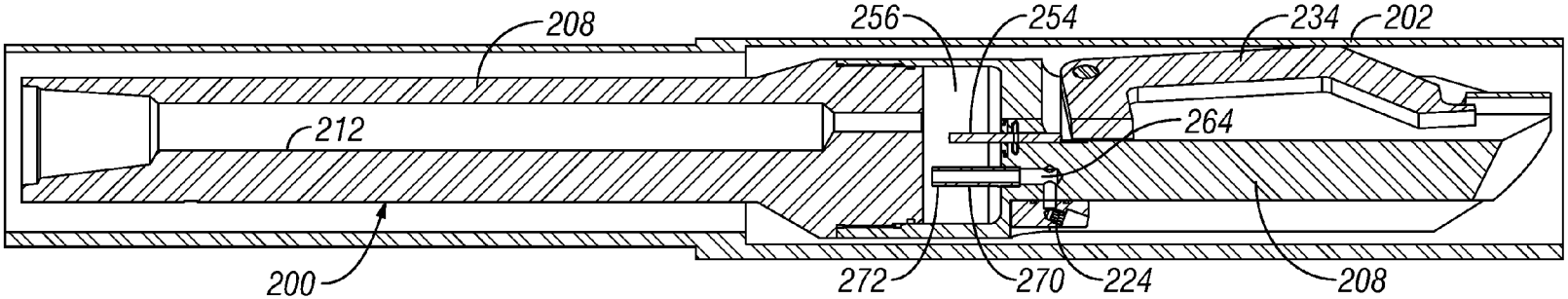
FIG. 8 is a sectional view through the jet cutting tool of FIG. 5 taken along line 8-8 in FIG. 6.
Figure 9:
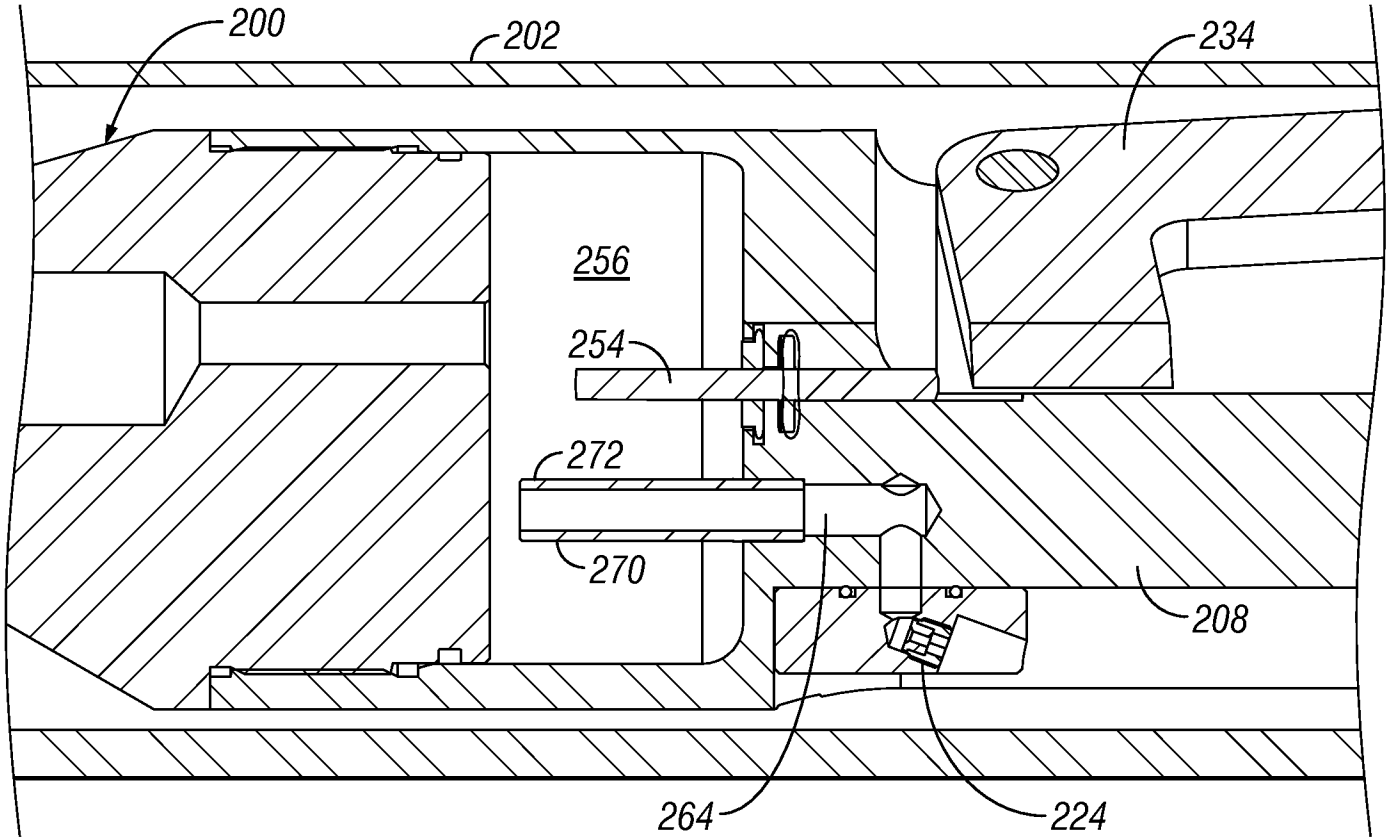
FIG. 9 is an enlarged sectional view of that portion of cutting tool of FIG. 8 that includes the nozzles.

With specific reference now to FIG. 8 and also the enlarged view in FIG. 9, the preferred nozzle assembly 270 will be described. As in the previous embodiment, a jetting port 264 connects the nozzle 224 to the hydraulic chamber 256. In this embodiment, a sand relief tube 272 extends up from the jetting port 264 a distance into the chamber 256. This reduces the likelihood that sand will settle out and block the nozzle 224 when flow is interrupted. Use of this tool is similar to that described above in reference to the embodiment of FIG. 3.

Because the outer pipe is further from the jet nozzles, the cutting time for a jet from a particular conventional jet nozzle is longer for the outer pipe than it is for the inner pipe. For example, it might take about five (5) minutes to pierce the inner pipe. Once the inner pipe is perforated, the jet immediately begins working on the outer pipe wall.

Figure 10:
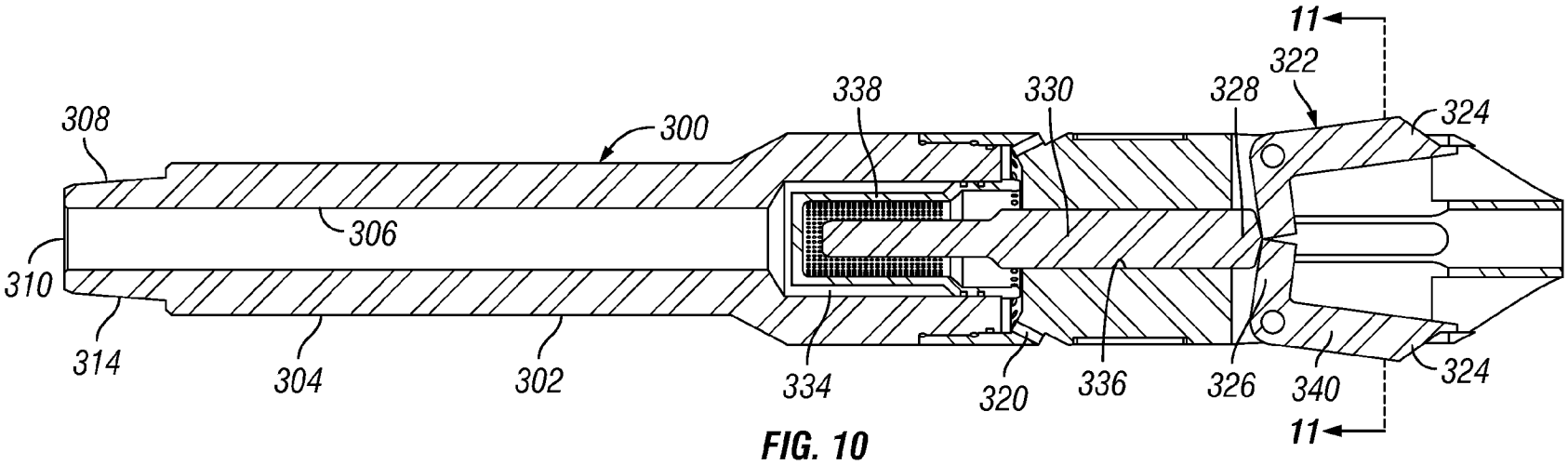
FIG. 10 is a longitudinal sectional view through a jet cutting tool constructed in accordance with a third embodiment of the present invention.
Figure 11:
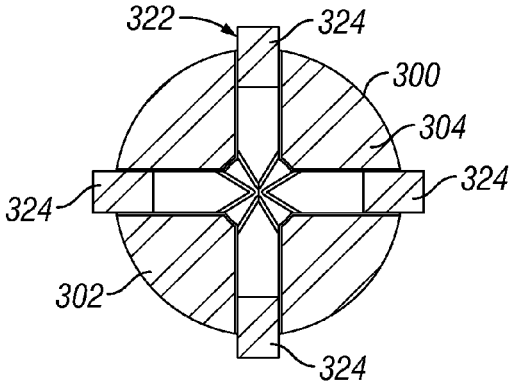
FIG. 11 is a cross-sectional view through the jet cutting tool of FIG. 10 taken along line 11-11 of FIG. 10.
Figure 12:
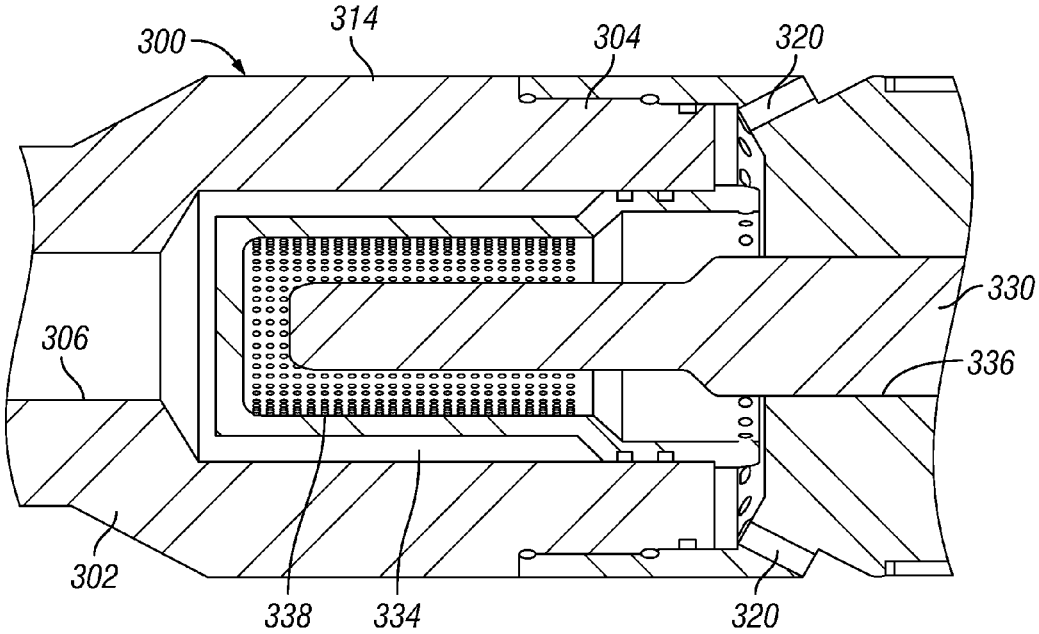
FIG. 12 is an enlarged sectional view of that portion of cutting tool of FIG. 10 that includes the nozzles.

With reference now to FIGS. 10-12, there is shown therein an abrasive jet cutter/perforator constructed in accordance with a third preferred embodiment of the present invention and designated generally by the reference numeral 300. The tool 300 comprises a tubular housing 302 having a sidewall 304 that defines a fluid channel 306. The uphole end 308 of the housing 302 has an inlet 310 for the fluid channel 306. The uphole end 308 is connectable to coiled tubing or other drill string, such as by threads 314, and through which abrasive fluid can be pumped.

A plurality of jet nozzles, designated generally at 320, is mounted in the sidewall 304 of the housing 302. In FIGS. 10-12, the nozzles are shown simply as channels machined into the sidewall 304. However, in most instances a nozzle insert will be inserted into each of these channels; the inserts have been omitted in the drawings for clarity of illustration. In this embodiment there are numerous nozzles 320 spaced equidistantly around the housing sidewall 304; for example, there may be as many as 30-40 nozzles. This permits a large number of perforations to be made simultaneously around the entire internal circumference of the pipe.

As in the previously described embodiments, the nozzles 320 fluidly communicate with the fluid channel 306 and are positioned to direct a fluid jet at a selected angle, referred to herein as the "jetting angle." The selected jetting angle is non-normal to the target surface. Also in a manner similar to the previously described embodiments, the tool 300 may be dimensioned so as to provide a selected radial distance between the nozzles 320 and the target surface.

The tool 300 may be used with a motor for cutting off the pipe or without a motor for perforating operations, where rotation is unnecessary. This tool includes a centering assembly 322 which may be employed in both types of operations. Most preferably, the centering assembly 322 comprises two or more centering members, such as the arms 324. In the embodiment shown, and as best seen in FIG. 11, there are four centering arms 324 supported equidistantly in the tool. Each of the centering arms is similar in structure and operation to the positioning members of the previous embodiments and so will not be described in detail again here. Each arm 324 is a pivotally mounted L-shaped member supported for movement between an extended position, as shown in FIG. 10, and a retracted position (not shown).

As FIG. 10 shows, the shorter section 326 of each arm 324 engages the distal or downhole end 328 of a cylindrical piston 330. A hydraulic chamber 334 is formed inside the housing 302. The chamber 334 has an inlet fluidly connected to the fluid channel 306 and includes a piston bore 336 for slidably receiving the piston 330 so that the upper end of the piston is responsive to pressure changes in the chamber 334. A filter sleeve 338 (see also FIG. 12) may be included to prevent particulate matter from clogging the nozzles 320.

Now it will be apparent that, as the piston 330 moves downwardly in response to increasing hydraulic pressure in the chamber 334, the lower end 328 of the piston pushes down on the shorter section 326 of the arms 324, pivoting the longer section 340 out toward the inner pipe wall opposite the target surface. Abrasive fluid passes through the filter sleeve 338 in the hydraulic chamber 334, and then through the nozzles 320.

In the embodiment shown in FIGS. 10-12, the arms 324 may be dimensioned to engage the target surface and thereby center the tool 300 in the pipe bore and also resist axial and rotational movement of the tool during a perforating procedure. Alternately, the arms 324 may be dimensioned to have a maximum outer diameter slightly less than the inner diameter of the pipe bore so as to allow free rotation of the tool for a cutting off procedure. In the cutting off operation, the arms 324 still provide the centering function and help to maintain all the nozzles 320 at about the same selected radial distance from the target surface.

Now it will be appreciated that because the nozzles in the tools of the present invention are supported at an angle to the target surface on the inner pipe, the effective cutting distance of the fluid jets from the nozzles is shortened. Moreover, the cutting time for the inner pipe is substantially less than the cutting time for the outer pipe so that cutting of the outer pipe can be avoided by limiting the operating time on the target surface. The cutting time for the inner and outer pipes can be controlled by varying the jetting angle and, in most cases, also by controlling the radial distance between the nozzle and the target surface. Still further, time lapse between perforation of the inner pipe and significant erosion on the outer pipe is also extended. This makes it more likely that the operation can be timed to successfully perforate the inner pipe and yet avoid cutting the outer pipe.

While the relative cutting times for the inner and outer pipes may vary, in a preferred practice of the present invention, the non-normal jetting angle and the radial distance between the jet nozzle and the target surface are selected to provide a maximum inner pipe cutting time of about ten (10) to about fifteen (15) minutes. Again, while the duration of the interval between cutting the inner pipe and outer pipe may vary, preferably the non-normal jetting angle and preferably also the radial distance between the jet nozzle and the target surface are selected to provide an interval of at least about five (5) minutes between the maximum inner pipe cutting time and the minimum outer pipe cutting time.

More preferably, the non-normal jetting angle and the radial distance between the jet nozzle and the target surface are selected to provide a minimum outer pipe cutting time that is at least about twice as long as the maximum inner pipe cutting time. For example, if the maximum inner pipe cutting time is about five (5) minutes, then preferably the minimum outer pipe cutting time is ten (10) minutes.

The cutting time ranges for the inner and outer pipe may vary, as may the time interval between the maximum cutting time for the inner pipe and the minimum cutting time for the outer pipe. However, in accordance with the present invention, the inner to outer pipe cutting time interval must be an operatively effective time interval, that is, the time interval must be sufficient to allow the operator of the cutoff/perforating operation to confirm the completion of the cutting on the inner pipe and terminate the fluid pumping before substantial damage to the outer pipe has occurred. As used herein, "substantial damage" refers to a degree of damage sufficient to require repair or replacement of the outer pipe in order to restore its functionality. The need to repair or replace is triggered by a loss of pressure and leakage from the casing, for example.

As the range of pipe and casing sizes commonly used in the oilfield is limited, the optimum jetting angle and nozzle-to-surface distance may be determined by testing tools and pipes of different sizes. Such testing will take into consideration other relevant variables, such as the composition of the abrasive fluid, the diameter of the jet nozzle, the pumping pressure across the jet nozzle, and hydrostatic pressure.

In accordance with the method of the present invention, a pipe in an oil or gas well may be cutoff or perforated. This method preferably is employed for cutting or perforating one pipe, such as coiled tubing or a drill string, that is disposed partially or whole inside another pipe, such as well casing. First, at least one jet nozzle is positioned at a selected jetting angle that is non-normal to the target surface. Additionally, the nozzle may be positioned at a selected radial distance from the target surface.

In the case of a perforating operation, the positioning step may include positioning the jet nozzle adjacent the target surface in the inner pipe. Alternately, where multiple, equally spaced nozzles are utilized, the tool may be centered in the bore. Preferably, the hydraulic pressure generated by pumping the abrasive fluid is used to accomplish this positioning. With the nozzle held in a fixed position, abrasive fluid is pumped through the nozzle for an operatively effective period. This period is selected to be long enough to allow completion of the perforating operation but short enough to prevent substantial damage to the outer pipe.

In the case of cutoff operations, after the tool is positioned at the selected level in the well, the tool is rotated while the abrasive fluid is pumped. The rotation and pumping is continued for an operatively effective period. This period is selected to be long enough to allow completion of the cutoff operation but short enough to prevent substantial damage to the outer pipe.

For the purpose of this description, the words left, right, front, rear, top, bottom, inside, outside, uphole, and downhole may be used to describe the various parts and directions of the invention as depicted in the drawings. These descriptive terms should not be considered as limiting the possible orientations of the invention or how it may be used. The terms are merely used to describe the various parts and directions so they may be readily understood and located in the drawings.

The embodiments shown and described above are exemplary. Many details are often found in the art and, therefore, many such details are neither shown nor described herein. It is not claimed that all of the details, parts, elements, or steps described and shown were invented herein. Even though numerous characteristics and advantages of the present inventions have been described in the drawings and accompanying text, the description is illustrative only. Changes may be made in the details, especially in matters of shape, size, and arrangement of the parts within the principles of the inventions to the full extent indicated by the broad meaning of the terms of the attached claims. The description and drawings of the specific embodiments herein do not point out what an infringement of this patent would be, but rather provide an example of how to use and make the invention. Likewise, the abstract is neither intended to define the invention, which is measured by the claims, nor is it intended to be limiting as to the scope of the invention in any way. Rather, the limits of the invention and the bounds of the patent protection are measured by and defined in the following claims.

What is claimed is:

1. An abrasive jet cutting tool for cutting or perforating a target surface of a pipe or casing downhole in an oil or gas well, wherein the well comprises an outer pipe and an inner pipe, the tool being connectable to a drill string through which abrasive fluid can be pumped, the tool comprising:

a housing having a sidewall defining a fluid channel, the housing having an uphole end with an inlet to the fluid channel, the uphole end being connectable to the drill string; and at least one jet nozzle in the housing sidewall in fluid communication with the fluid channel and positioned to direct a fluid jet at a selected jetting angle that is non-normal to the target surface;

wherein the housing is configured to support the at least one jet nozzle a selected radial distance from the target surface while abrasive fluid is pumped through the drill string and wherein the radial distance of the at least one jet nozzle from the target surface is selected to achieve an operatively effective time interval between the maximum time required to complete the cutting operation on the inner pipe and the minimum time to cause substantial damage to the outer pipe;

wherein the jetting angle is selected to achieve an operatively effective time interval between the maximum time required to complete the cutting operation on the inner pipe and the minimum time to cause substantial damage to the outer pipe; and at least one positioning member comprising a pivotally mounted arm extendable and retractable from the housing opposite the at least one jet nozzle and adapted to shift the housing radially toward the target surface to achieve the selected radial distance from the target surface, wherein the at least one positioning member is hydraulically operated by the abrasive fluid;

wherein the housing defines a hydraulic chamber and further comprises a piston mounted for movement in response to fluid pressure in the hydraulic chamber and to operate the at least one positioning member in response thereto.

2. The abrasive jet cutting tool of claim 1 further comprising a jetting port that fluidly connects each of the at least one jet nozzles to the hydraulic chamber.

3. The abrasive jet cutting tool of claim 2 further comprising a sand relief tube extending a distance from each of the jetting ports into the hydraulic chamber.

4. The abrasive jet cutting tool of claim 1 wherein the at least one jet nozzle comprises a plurality of jet nozzles.

5. The abrasive jet cutting tool of claim 1 wherein the outer diameter of the housing is selected based on the inner diameter of the inner pipe to achieve the selected radial distance between the jet nozzle and the target surface.

6. The abrasive jet cutting tool of claim 1 wherein the non-normal jetting angle and the radial distance between the jet nozzle and the target surface are selected to provide a maximum inner pipe cutting time of about five to about ten minutes.

7. The abrasive jet cutting tool of claim 6 wherein the non-normal jetting angle and the radial distance between the jet nozzle and the target surface are selected to provide an interval of at least about ten to about fifteen minutes between the maximum inner pipe cutting time and the minimum outer pipe cutting time.

8. The abrasive jet cutting tool of claim 6 wherein the non-normal jetting angle and the radial distance between the jet nozzle and the target surface are selected to provide an interval of at least about five minutes between the maximum inner pipe cutting time and the minimum outer pipe cutting time.

9. The abrasive jet cutting tool of claim 1 wherein the non-normal jetting angle and the radial distance between the jet nozzle and the target surface are selected to provide a minimum outer pipe cutting time that is at least about twice as long as the maximum inner pipe cutting time.

10. The abrasive jet cutting tool of claim 1 wherein the at least one jet nozzle comprises a plurality of jet nozzles positioned equidistantly around the circumference of the tool housing.

11. The abrasive jet cutting tool of claim 10 wherein the at least one positioning member comprises a plurality of positioning members.

12. An abrasive jet cutting assembly comprising the cutting tool of claim 1 and a motor for rotating the tool on the drill string.

13. A method for cutting off or perforating a target surface of a pipe or casing downhole in an oil or gas well, wherein the well comprises an outer pipe and an inner pipe, the method comprising:

positioning at least one jet nozzle at a selected jetting angle that is non-normal to target surface;

positioning the at least one jet nozzle at a selected radial distance from the target surface;

wherein the non-normal jetting angle and the radial distance between the jet nozzle and the target surface are selected to provide a minimum outer pipe cutting time that is at least about twice as long as the maximum inner pipe cutting time; and pumping an abrasive fluid through the at least one jet nozzle for an operatively effective time period selected to allow completion of the cutoff or perforating operation on the inner pipe and to prevent substantial damage to the outer pipe.

14. The method of claim 13 wherein the positioning step is carried out by shifting the jet nozzle radially toward the target surface.

15. The method of claim 14 wherein the shifting of the jet nozzle is carried out using hydraulic pressure.

16. The method of claim 13 wherein the tool is held in a fixed position while the abrasive fluid is pumped to perforate the inner pipe.

17. The method of claim 13 wherein the tool is rotated while the abrasive fluid is pumped.

18. The method of claim 13 wherein the at least one jet nozzle comprises a plurality of jet nozzles positioned to direct fluid jets equidistantly around the internal circumference of the pipe or casing.

19. The method of claim 18 wherein the positioning step is carried out by centering the jet nozzles inside the pipe or casing.

20. The method of claim 19 wherein the centering is carried out using hydraulic pressure.

21. The method of claim 20 wherein the tool is held in a fixed position while the abrasive fluid is pumped to perforate the inner pipe.

22. The method of claim 21 wherein the tool is rotated while the abrasive fluid is pumped.

23. A method for cutting off or perforating a target surface of a pipe or casing downhole in an oil or gas well, wherein the well comprises an outer pipe and an inner pipe, the method comprising:

positioning at least one jet nozzle at a selected jetting angle that is non-normal to target surface;

positioning the at least one jet nozzle at a selected radial distance from the target surface;

wherein the non-normal jetting angle and the radial distance between the jet nozzle and the target surface are selected to provide a minimum outer pipe cutting time that is at least about twice as long as the maximum inner pipe cutting time; and pumping an abrasive fluid through the at least one jet nozzle for an operatively effective time period selected to allow completion of the cutoff or perforating operation on the inner pipe and to prevent substantial damage to the outer pipe.

24. The method of claim 23 wherein the step of positioning the at least one jet nozzle at a selected radial distance from the target surface is carried out by shifting the jet nozzle radially toward the target surface.

25. The method of claim 24 wherein the shifting of the jet nozzle is carried out using hydraulic pressure.

26. The method of claim 23 wherein the tool is held in a fixed position while the abrasive fluid is pumped to perforate the inner pipe.

27. The method of claim 23 wherein the tool is rotated while the abrasive fluid is pumped.

28. The method of claim 23 wherein the at least one jet nozzle comprises a plurality of jet nozzles positioned to direct fluid jets equidistantly around the internal circumference of the pipe or casing.

29. The method of claim 23 wherein the step of positioning the plurality of jet nozzles at a selected radial distance from the target surface is carried out by centering the jet nozzles inside the pipe or casing.

30. The method of claim 29 wherein the centering is carried out using hydraulic pressure.

31. The method of claim 30 wherein the tool is held in a fixed position while the abrasive fluid is pumped to perforate the inner pipe.

32. The method of claim 31 wherein the tool is rotated while the abrasive fluid is pumped.

33. An abrasive jet cutting tool for cutting or perforating a target surface of a pipe or casing downhole in an oil or gas well, wherein the well comprises an outer pipe and an inner pipe, the tool being connectable to a drill string through which abrasive fluid can be pumped, the tool comprising:

a housing having a sidewall defining a fluid channel, the housing having an uphole end with an inlet to the fluid channel, the uphole end being connectable to the drill string; and a plurality of jet nozzles in the housing sidewall positioned equidistantly around the circumference of the housing and in fluid communication with the fluid channel and positioned to direct a fluid jet at a selected jetting angle that is non-normal to the target surface; and a centering assembly extendable and retractable from the housing and adapted to center the tool in the pipe or casing during the cutting or perforating operation, wherein the centering assembly comprises a plurality of position members, and wherein the plurality of positioning members are hydraulically operated by the abrasive fluid;

wherein the jetting angle is selected to achieve an operatively effective time interval between the maximum time required to complete the cutting operation on the inner pipe and the minimum time to cause substantial damage to the outer pipe;

wherein the housing defines a hydraulic chamber and further comprising a piston mounted for movement in response to fluid pressure in the hydraulic chamber and to operate the centering assembly in response thereto.

34. An abrasive jet cutting assembly comprising the cutting tool of claim 33 and a motor for rotating the tool on the drill string.

* * * * *

UNITED STATES PATENT AND TRADEMARK OFFICE

CERTIFICATE OF CORRECTION

PATENT NO. : 9,228,422 B2
APPLICATION NO. : 13/749434
DATED : January 5, 2016
INVENTOR(S) : Brock W. Watson and Roger L. Schultz It is certified that error appears in the above-identified patent and that said Letters Patent is hereby corrected as shown below:

In the Specification:

Column 1, line 24: replace “illustrates” with --illustrate--.
Column 1, line 32: replace “is longitudinal” with --is a longitudinal--.
Column 1, line 50: replace “portion of” with --portion of the--.
Column 1, line 57: replace “portion of” with --portion of the--.
Column 1, line 64: replace “of pipe” with --of a pipe--.
Column 2, line 4: replace “shown FIG.” with --shown in FIG.--.
Column 2, line 31: replace “access to the” with --access the--.
Column 3, line 54: replace “to target” with --to the target--.
Column 3, line 59: replace “tubular similar” with --tubular member similar--.
Column 4, line 15: replace “that upper” with --that the upper--.
Column 4, line 28: replace “134 as” with --134, as--.
Column 4, line 29: replace “wall will” with --wall, will--.
Column 7, line 47: replace “inventions” with --invention--.
Column 7, line 50-51: replace “inventions” with --invention--.

In the Claims:

Column 9, line 60: replace “to target” with --to the target--.

Signed and Sealed this
Nineteenth Day of April, 2016

Michelle K. Lee

Michelle K. Lee
*Director of the United States Patent and Trademark Office*